US006782923B2

(12) United States Patent
Covelli

(10) Patent No.: US 6,782,923 B2
(45) Date of Patent: Aug. 31, 2004

(54) WEFT-STRETCH WOVEN FABRIC WITH HIGH RECOVERY

(75) Inventor: Carmen A. Covelli, Chadds Ford, PA (US)

(73) Assignee: Invista North America, S.a.r.L., Wilmington, DE (US)

( * ) Notice: Subject to any disclaimer, the term of this patent is extended or adjusted under 35 U.S.C. 154(b) by 51 days.

(21) Appl. No.: 10/047,730

(22) Filed: Nov. 13, 2001

(65) Prior Publication Data

US 2003/0092339 A1 May 15, 2003

(51) Int. Cl.[7] ..... D03D 47/02; D03D 47/10

(52) U.S. Cl. ..... 139/440; 139/420 R; 139/421; 139/422; 139/426 R

(58) Field of Search ..... 139/440, 420 R, 139/421, 422, 426 R

(56) References Cited

U.S. PATENT DOCUMENTS

| | | | | | |
|---|---|---|---|---|---|
| 2,312,226 | A | * | 2/1943 | Woodward | 139/419 |
| 3,373,774 | A | * | 3/1968 | Cruz | 139/420 R |
| 3,671,379 | A | * | 6/1972 | Scherbel | 428/362 |
| 4,636,426 | A | | 1/1987 | Fleischer | |
| 4,660,605 | A | * | 4/1987 | Koch | 139/420 R |
| 5,922,433 | A | | 7/1999 | Scherbel | |
| 6,462,145 | B1 | * | 10/2002 | Fleri et al. | 525/444 |
| 6,495,254 | B1 | * | 12/2002 | Abe et al. | 428/364 |
| 6,503,623 | B1 | * | 1/2003 | Oue et al. | 428/364 |

FOREIGN PATENT DOCUMENTS

| | | |
|---|---|---|
| EP | 1059372 A2 | 12/2000 |
| FR | 2742171 | 6/1997 |
| WO | WO 01/53573 A1 | 7/2001 |
| WO | WO 01/64978 A2 | 9/2001 |

* cited by examiner

*Primary Examiner*—John J. Calvert
*Assistant Examiner*—Robert H. Muromoto
(74) *Attorney, Agent, or Firm*—Robert B. Furr, Jr.

(57) ABSTRACT

A woven fabric comprising warp fibers and a weft is provided. The weft may be of pick-and-pick or co-insertion constructions. The weft includes a spun staple yarn and a polyester bicomponent filament. The polyester bicomponent filament includes poly(ethylene terephthalate) and poly (trimethylene terephthalate), and has an after heat-set crimp contraction value of from about 10% to about 80%. A process for making such a fabric is also provided.

10 Claims, 1 Drawing Sheet

FIG. 3
*Conventional*
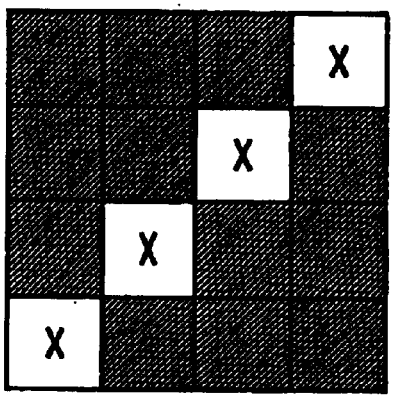
FIG. 4
*Conventional*
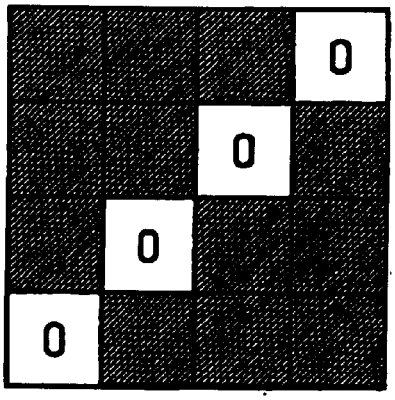

WEFT-STRETCH WOVEN FABRIC WITH HIGH RECOVERY

BACKGROUND OF THE INVENTION

1. Field of the Invention

The present invention relates to weft-stretch woven fabrics comprising a spun staple yarn and a polyester bicomponent continuous filament comprising poly(ethylene terephthalate) and poly(trimethylene terephthalate) in the weft of the fabric.

2. Description of Background Art

Polyester bicomponent filaments are disclosed in U.S. Pat. No. 3,671,379, and napped stretch fabrics of spun staple yarns are disclosed in U.S. Pat. No. 5,922,433. However, the fabrics disclosed in these references do not have sufficient recovery after stretching unless the bicomponent level is high, and fabrics having improved recovery are still desired.

SUMMARY OF THE INVENTION

The invention provides a woven fabric comprising warp fibers and a weft wherein:

a) the weft is selected from the group consisting of pick-and-pick and co-insertion constructions;

b) the weft comprises a spun staple yarn and a polyester bicomponent filament wherein said polyester bicomponent filament comprises poly(ethylene terephthalate) and poly(trimethylene terephthalate); and c) the polyester bicomponent filament has an after heat-set crimp contraction value of from about 10% to about 80%.

The spun staple yarn can be cotton. The fabric can have a weft elongation of from about 12% to about 35%. The weft of the fabric of the invention can have a pick-and-pick construction or can have a co-insertion construction. In a preferred embodiment, the polyester bicomponent filament has an after heat-set crimp contraction value of at least about 35%. The fabric can be a twill, for example a twill fabric having a normalized unload power of at least about 2.2 N-m/g. The fabric can comprise spun staple yarns as warp fibers.

The fabric of the invention can have a warp elongation of from about 15% to about 35% and can comprise from about 5 wt % to about 25 wt % bicomponent filament, based upon the total weight of the fabric.

The invention further provides a process for making a weft-stretch fabric. The method of the invention includes the steps of:

a) providing a bicomponent filament comprising poly (ethylene terephthalate) and poly(trimethylene terephthalate), said bicomponent filament having an after heat-set crimp contraction value of at least about 10%;

b) providing a spun staple yarn;

c) providing warp fibers; and d) weaving the bicomponent filament and the spun staple yarn with the warp fibers by a method selected from the group consisting of co-insertion and pick-and-pick to form the fabric.

In a preferred embodiment, the spun staple yarn of step (b) is cotton. The weaving method of step (d) can be pick-and-pick. In another embodiment of the method, the bicomponent filament has an after heat-set crimp contraction value of from about 35% to about 80%. The weaving method can be co-insertion. In a preferred embodiment, the method further comprises providing the bicomponent filament in an amount such the fabric of step (d) comprises from about 5 wt % to about 25 wt % bicomponent filament, based on total weight of fabric.

BRIEF DESCRIPTION OF THE FIGURES

FIGS. 3 and 4 are lift plans of weft-stretch fabric not of the invention, viewed from the face of the fabric.

DETAILED DESCRIPTION OF THE INVENTION

It has now been found that certain weft-stretch woven fabric constructions having polyester bicomponent filaments in the weft have much higher unload power than would be expected from the amount of bicomponent filament present. High unload power is desirable because it provides good recovery after a fabric is stretched.

As used herein, "pick-and-pick" means a weaving method and a woven construction in which the polyester bicomponent filament and a spun staple weft yarn are woven in alternating picks.

"Co-insertion" means a weaving method and a woven construction in which the polyester bicomponent filament and a spun staple weft yarn are woven as one, in the same pick. Both methods and constructions are to be distinguished from methods and constructions in which only the polyester bicomponent filament or only the spun staple yarn are used in the weft.

"Polyester bicomponent filament" means a continuous filament comprising a pair of polyesters intimately adhered to each other along the length of the fiber, so that the fiber cross-section is for example a side-by-side, eccentric sheath-core or other suitable cross-section from which useful crimp can be developed.

The polyester bicomponent filament used in the fabric and process of the invention comprises poly(ethylene terephthalate) and poly(trimethylene terephthalate) in a weight ratio of about 30/70 to 70/30 and has an after heat-set crimp contraction value of at least about 10%, preferably at least about 35% and at most about 80%. It is preferred that the bicomponent filament be present in the fabric to an extent of at least about 5 wt % and at most about 25 wt %, based on the total weight of the fabric. The spun staple yarn also used in the weft can be of cotton, wool, linen, polycaprolactam, poly(hexamethylene adipamide), poly (ethylene terephthalate), poly(trimethylene terephthalate), and the like. Cotton is preferred.

Figure 2:
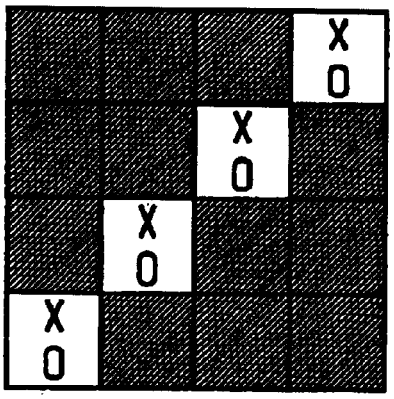
FIG. 2 is a lift plan for a weft-stretch co-insertion fabric of the invention, viewed from the face of the fabric.

The woven fabric of the invention has a pick-and-pick or co-insertion construction, and can be a plainwoven, twill (for example 2/1, 3/1, 2/2, 1/2, 1/3, herringbone, and pointed twills), weft rib (for example 2/3 and 2/2 weft ribs), or satin fabric. In the Figures, a white cell means a (warp) end is under a (weft) pick, a shaded cell means a (warp) end is over a (weft) pick, an X indicates a polyester bicomponent filament pick, and an O indicates a spun staple yarn pick. In FIG. 2, the polyester bicomponent weft filament and spun staple weft yarn are shown weaving as one (co-insertion).

Preferably, the fabric of the invention has a weft elongation of at least about 12% and a normalized weft unload power of at least about 2.2 N-m/g. Lower elongations can be difficult to sense in everyday use, and fabrics with lower unload power can become undesirably baggy and misshapen in use. To control fabric growth, it is further preferred that weft elongation be no more than about 35%.

There are no particular restrictions on the warp fibers of the fabric, provided the benefits of the present invention are not compromised, and spun staple fibers of cotton, polycaprolactam, poly(hexamethylene adipamide), poly (ethylene terephthalate), poly(trimethylene terephthalate), wool, linen, and blends thereof can be used, as can filaments of polycaprolactam, poly(hexamethylene adipamide), poly (ethylene terephthalate), poly(trimethylene terephthalate), poly(tetramethylene terephthalate), spandex, and blends thereof. If a filament or yarn having stretch-and-recovery properties (for example spandex, polyester bicomponent fibers, and the like) is used in the warp, the fabrics can have warp-stretch as well as weft-stretch characteristics. For example the elongation in the warp direction can be at least about 15% and is preferred to be no more than about 35%.

Various comonomers can be incorporated into the polyesters of the bicomponent filament in minor amounts (typically no more than about 15 mole percent), if the benefits of the invention are not deleteriously affected. Examples include linear, cyclic, and branched aliphatic dicarboxylic acids (and their diesters) having 4–12 carbon atoms; aromatic dicarboxylic acids (and their diesters) having 8–12 carbon atoms (for example isophthalic acid, 2,6-naphthalenedicarboxylic acid, and 5-sodium-sulfoisophthalic acid); and linear, cyclic, and branched aliphatic diols having 3–8 carbon atoms (for example 1,3-propane diol, 1,2-propanediol, 1,4-butanediol, 3-methyl-1, 5-pentanediol, 2,2-dimethyl-1,3-propanediol, 2-methyl-1,3-propanediol, and 1,4-cyclohexanediol). The polyesters can also have incorporated therein additives such as titanium dioxide.

In the process of the invention, a bicomponent filament is provided that comprises poly(ethylene terephthalate) and poly(trimethylene terephthalate) and has an after heat-set crimp contraction value of at least about 10%. A spun staple yarn and warp fibers are also provided. The bicomponent filament and the spun staple yarn are woven with the warp fibers by a method selected from the group consisting of co-insertion and pick-and-pick to form the fabric. The bicomponent weft filament, spun staple weft yarn, warp fibers, and fabric can have the composition, construction, and properties described elsewhere herein.

Loom types that can be used to make the woven fabrics of the invention and in the process of the invention include air-jet looms, shuttle looms, water-jet looms, rapier looms, and gripper (projectile) looms.

The after heat-set crimp contraction value of the polyester bicomponent filament used in the Example was measured as follows. Each filament sample was formed into a skein of 5000 +/−5 total denier (5550 dtex) with a skein reel at a tension of about 0.1 gpd (0.09 dN/tex). The skein was conditioned at 70 +/−2° F. (21 +/−1° C.) and 65 +/−2% relative humidity for a minimum of 16 hours. The skein was hung substantially vertically from a stand, a 1.5 mg/den (1.35 mg/dtex) weight (e.g. 7.5 grams for a 5550 dtex skein) was hung on the bottom of the skein, the weighted skein was allowed to come to an equilibrium length, and the length of the skein was measured to within 1 mm and recorded as "$C_b$". The 1.35 mg/dtex weight was left on the skein for the duration of the test. Next, a 500 gram weight (100 mg/d; 90 mg/dtex) was hung from the bottom of the skein, and the length of the skein was measured to within 1 mm and recorded as "$L_b$". Crimp contraction value (percent) (before heat-setting, as described below for this test), "$CC_b$", was calculated according to the formula $$CC_b=100\times(L_b-C_b)/L_b$$

The 500 g weight was removed, and the skein was then hung on a rack and heat-set, with the 1.35 mg/dtex weight still in place, in an oven for 5 minutes at about 250° F. (121° C.), after which the rack and skein were removed from the oven and conditioned as above for two hours. This step is designed to simulate commercial dry heat-setting, which is one way to develop the final crimp in the bicomponent fiber. The length of the skein was measured as above, and its length was recorded as "$C_a$". The 500-gram weight was again hung from the skein, and the skein length was measured as above and recorded as "$L_a$". The after heat-set crimp contraction value (percent), "$CC_a$", was calculated according to the formula $CC_a=100\times(L_a-C_a)/L_a$.

To determine finished fabric weft unload power, three specimens of 3 in×8 in (7.6 cm×20.3 cm) were cut from the fabric and folded in the middle to form an open loop. The long dimension of each specimen corresponded to the weft direction of the fabric and was the dimension that was tested. Each open loop was stitched together about 1 inch (2.5 cm) from its ends to form a closed loop 6 inches (15.2 cm) in circumference. The fabric loop, were tested with an Instron tensile tester with a 6-inch (15.2 cm) cross head, pneumatic clamps (size 3C, having 1 in×3 in (2.5×7.6 cm) flat faces, 80 psi (552 kPa) air supply), and 10 inches per minute (25.4 cm/min) chart speed. A u-shaped rod was clamped sideways between one of the sets of clamps of the tensile tester so that the ends of the rod (2.78 in (7 cm) between the ends, 3 in (7.6 cm) around the ends) projected from the clamps far enough to hold the fabric loop securely. The loop was placed around the projecting rod ends and stretched to a 12-pound (5.4 kg) force and relaxed; the cycle was performed a total of 3 times. Unload power was measured at "5% available stretch" on the $3^{rd}$ cycle relaxation (that is, when the fabric had been relaxed 5% based on the extended length at 12-pound (5.4 kg) force on the $3^{rd}$ cycle) and reported in Newtons per centimeter. In order to compare fabrics of different basis weights and compositions, the unload power was normalized by dividing the as determined unload power by the fabric basis weight and by the weight percent polyester bicomponent fiber in the fabric. The polyester bicomponent fiber used in the following examples is Type-400(r) brand poly(ethylene terphthalate)/poly(trimethylene terephthalate) bicomponent fiber, commercially available from E. I. du Pont de Nemours and Company, 1007 Market Street; Wilmington, Del. 19805. Type-400(r) brand polyester bicomponent fiber is also referred to herein as T-400(r) brand polyester bicomponent fiber, or simply "T-400(r). Percent elongation was measured under 12-pound (5.4 kg) force on the $3^{rd}$ cycle.

All the Samples in the Example were 3/1 twills.

EXAMPLE

Figure 1:
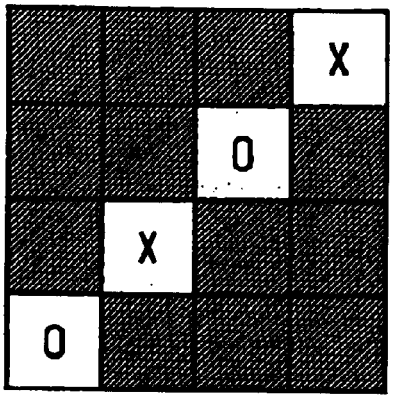
FIG. 1 is a lift plan for a weft-stretch pick-and-pick fabric of the invention, viewed from the face of the fabric.

Fabrics were woven on a Dornier airjet loom using a warp of 18/1 cc cotton at a greige warp count of 96 ends/inch (38 ends/cm) and weft yarns of 36 cc cotton and/or 150 denier (167 dtex) T-400 poly(ethylene terephthalate)//poly (trimethylene terephthalate) bicomponent fiber (E. I. du Pont de Nemours and Company) having an after heat-set crimp contraction value of 39%. Samples 1 and 2 were woven following the lift plan of FIG. 1, and Samples 3 and 4 were woven following the lift plan of FIG. 2. Samples 3 and 4 differed from each other in that the polyester bicomponent filament package and the cotton package were exchanged on the loom so that the order of yarn insertion was reversed. Comparison Samples 1 and 2, which were also 3/1 twills, were woven following the lift plans of FIGS. 3 and 4, respectively. The loom conditions were the same for all the fabrics. After weaving, the fabrics were jet-scoured at 180° F. (82° C.) for 30 min, jet-dyed with a disperse dye at 265° F. (129° C.) and then with a direct dye at 180° F. (82° C.) and then heat-set at 320° F. (160° C.) for 20 seconds at the dyed fabric width. Further details and results are given in Table I, in which "Comp." indicates a comparison sample, and weft and warp counts are in picks/cm and ends/cm respectively. The "normalized weft unload power" was calculated by dividing the weft unload power by the fabric basis weight and by the weight fraction of the T-400 fiber in the fabric and is expressed as Newton-meters per gram.

TABLE

| SAMPLE: | 1 | 2 | 3 | 4 | Comp. 1 | Comp. 2 |
|---|---|---|---|---|---|---|
| Weft Yarns | T-400(r) and cotton | T-400(r) and cotton | Cotton and T-400 | T-400(r) and cotton | T-400(r) only | Cotton only |
| Weft Construction | Pick-and-pick | Pick-and-pick | Co-insertion | Co-insertion | Every pick | Every pick |
| Greige Weft Count | 24 | 17 | 17 | 17 | 24 | 24 |
| Finished Weft Count | 31 | 21 | 20 | 21 | 30 | 29 |
| Finished Warp Count | 43 | 39 | 40 | 39 | 42 | 42 |
| Fabric Weight, g/m$^2$ | 232 | 237 | 266 | 272 | 258 | 179 |
| T-400, weight fraction | 0.131 | 0.093 | 0.170 | 0.170 | 0.303 | 0.0 |
| Elongation, % | 15.1 | 17.1 | 18.2 | 19.3 | 17.9 | 10.7 |
| Weft Unload Power, N/cm | 1.1 | 0.6 | 1.3 | 1.6 | 1.5 | 0.0 |
| Normalized Weft Unload Power, N-m/g | 3.6 | 2.7 | 2.8 | 3.4 | 1.9 | 0.0 |

The normalized unload power values in Table I show that the power of the pick-and-pick (Samples 1 and 2) and co-insertion fabrics (Samples 3 and 4) of the invention are unexpectedly and desirably much higher than would be expected from that of a fabric having only polyester bicomponent filaments in the weft (Comparison Sample 1).

What is claimed:

1. A woven fabric, comprising warp fibers and a weft wherein:

a) the weft is selected from the group consisting of pick-and-pick and co-insertion constructions;

b) the weft comprises a spun staple yarn and a polyester bicomponent filament wherein said polyester bicomponent filament comprises poly(ethylene terephthalate) and poly(trimethylene terephthalate);

c) the polyester bicomponent filament has an after heat-set crimp contraction value of from about 10% to about 80%; and d) the fabric comprises from about 5 wt % to about 25 wt % bicomponent filament and has a normalized unload power of at least about 2.2 N-m/g.

2. The fabric of claim 1 wherein:

the spun staple yarn is cotton; and the fabric has a weft elongation of from about 12% to about 35%.

3. The fabric of claim 1 wherein the weft is a pick-and-pick construction.

4. The fabric of claim 1 wherein the weft is a co-insertion construction.

5. The fabric of claim 1 wherein the polyester bicomponent filament has an after heat-set crimp contraction value of at least about 35%.

6. The fabric of claim 1 wherein:

the fabric is a twill; and the warp fibers are spun staple yarns.

7. The fabric of claim 1 having a warp elongation of from about 15% to about 35%.

8. A process for making a weft-stretch fabric comprising the steps of:

a) providing a bicomponent filament comprising poly(ethylene terephthalate) and poly(trimethylene terephthalate), said bicomponent filament having an after heat-set crimp contraction value of at least about 10%;

b) providing a spun staple yarn;

c) providing warp fibers; and d) weaving the bicomponent filament and the spun staple yarn with the warp fibers to form the fabric by a method selected from the group consisting of co-insertion and pick-and-pick; and wherein the fabric comprises from about 5 wt % to about 25 wt % bicomponent filament and has a normalized unload power of at least about 2.2 N-m/g.

9. The process of claim 8 wherein the spun staple yarn of step (b) is cotton and the weaving method of step (d) is pick-and-pick.

10. The process of claim 8 wherein:

the bicomponent filament of step (a) has an after heat-set crimp contraction value of from about 35% to about 80%; and the weaving method of step (d) is co-insertion.

* * * * *